US005595034A

United States Patent [19]

Krysalka et al.

[11] Patent Number: 5,595,034

[45] Date of Patent: Jan. 21, 1997

[54] GRID ASSEMBLY WITH IMPROVED FORM PAN FOR USE IN GRID REINFORCED CONCRETE DECKS AND METHOD OF MANUFACTURING SAME

[75] Inventors: William Krysalka, Zelianople; Jack Linderman, Tarentum, both of Pa.

[73] Assignee: Harsco Corporation, Wormleysburg, Pa.

[21] Appl. No.: 392,125

[22] Filed: Feb. 22, 1995

[51] Int. Cl.[6] ..... E04F 15/14

[52] U.S. Cl. ..... 52/318; 52/667; 52/338

[58] Field of Search ..... 52/667, 318, 338, 52/332, 333, 329, 414

[56] References Cited

U.S. PATENT DOCUMENTS

| | | | |
|---|---|---|---|
| 2,089,891 | 8/1937 | Greulich | 52/338 X |
| 2,114,773 | 4/1938 | Auten et al. | 52/338 X |
| 2,270,630 | 1/1942 | Greulich | 52/338 X |
| 2,275,104 | 3/1942 | Grenuch . | |
| 2,275,105 | 3/1942 | Greulich . | |
| 3,596,421 | 8/1971 | Miller | 52/338 X |
| 4,102,102 | 7/1978 | Greulich | 52/338 |
| 4,151,694 | 5/1979 | Sriberg et al. | 52/338 X |

OTHER PUBLICATIONS

IKG Grelich "Bridge Flooring Systems", 1991 entire document.

*Primary Examiner*—Carl D. Friedman
*Assistant Examiner*—Yvonne Horton-Richardson
*Attorney, Agent, or Firm*—Kerkam, Stowell, Kondracki & Clarke, P.C.; Edward J. Kondracki

[57] ABSTRACT

A grid assembly, and method for use in manufacturing a grid reinforced concrete deck, including a plurality of longitudinally extending main beams in parallel spaced relation, each of the main beams having a plurality of longitudinally spaced slots therein and a central flange thereon, a plurality of cross bars adapted to be inserted through the aligned slots and rotated into an upright position, a form pan extending between two adjacent main beams and having a first and a second side portion adapted to rest on the central flange of the two adjacent main beams, respectively, wherein the form pan includes at least a first ridge extending upwardly thereon, the first ridge having a height which enables a lower edge of the cross bars to come into contact therewith when in the upright position, wherein the contact causes a downward force on the first ridge which mechanically locks the form pan between the cross bars and the flange on the adjacent main beams.

25 Claims, 4 Drawing Sheets

GRID ASSEMBLY WITH IMPROVED FORM PAN FOR USE IN GRID REINFORCED CONCRETE DECKS AND METHOD OF MANUFACTURING SAME

BACKGROUND OF THE INVENTION

The present invention relates to the field of grid reinforced concrete bridge decks or grating, and, more particularly, to an improved form pan device for use with half-depth bridge decks or the like which enables mechanical locking of the form pan in its desired position.

Grid reinforced concrete bridge decks have been used in the past with significant success in that they provide a strong and relatively light weight deck compared to other types of bridge decking. Precast panels of grid reinforced concrete are far lighter and much stiffer than equivalent rebar reinforced slabs. A square foot of grid reinforced concrete deck weighs about half that of a one square foot of conventional, eight-inch, rebar reinforced deck. Field experience has shown that it is reasonable to expect at least a fifty-year life from a properly installed grid reinforced concrete deck. While the initial cost of a grid reinforced concrete deck may be somewhat higher than a rebar reinforced slab deck, it can be expected to last two or three times as long.

Grid reinforced concrete decks or gratings are shown, for example, in the patents to Greulich Nos. 2,089,891, 2,275,104 and 2,275,105. The procedure used in assembling these type of gratings is to space a plurality of main longitudinal beams, having slots therein spaced along the longitudinal axis thereof, a certain distance apart from one another with their slots aligned, insert a plurality cross bars transversely through the aligned slots while in a flat position relative to the main beams, and then turn the cross bars in the slots approximately 90 degrees to an upright position, thereby locking the main beams and cross bars together to form a rigid structure. Thereafter, tertiary longitudinal bars and/or rebars can be added intermediate the main beams. The cross bars may be fabricated with holes therein for receiving the rebars and complementary slots therein for receiving the tertiary bars.

Concrete form pans are provided under the grid formed by the beams and cross bars to enable the grid to be top-filled with concrete, thereby producing a grid reinforced concrete deck. In addition to its use on bridges, these type of decks can be used where any reinforced heavy duty flooring is desired, such as subway covers, vault covers, loading platforms and the like.

In one particular type of grid reinforced concrete deck, to which the instant invention is directed, only half the depth of the main beams is filled with concrete. This type of deck is known as a "half-depth" deck. The half-depth deck is made by positioning a concrete form pan under the cross bars at a mid-point on the height of the main beams, thereby enabling concrete to be top-filled into the grating, which results in a concrete thickness which is only half the height of the main beams. For example, if five inch main beams are used the resulting concrete thickness of a half-depth deck would be approximately two and one-half inches. Half-depth decks are preferred for certain application where it is desired to have a lighter weight deck than would otherwise result from filing the entire beam height with concrete.

Typically, the main beams include a center flange which extends along the length thereof and is used to support the form pan when making half-depth decks. Conventional form pans used in half-depth decks are flat pans having side portions intended to rest on the center flanges of two adjacent main beams, respectively. The bottom edge of the cross bars, when rotated upright in the main beam slots, do not contact the pan, but are spaced a certain distance therefrom, the amount of space depending on the height of the cross bars. Inasmuch as only the weight of the pan holds it in place on the center flanges, it is often necessary to tack weld the pan to the flanges to prevent movement thereof. Tack welding the form pans is time consuming, increases the manufacturing cost of the grid and causes undesirable warping which often allows liquid to seep beneath the center flanges. Tack welding the pan to the beam may also set up stress in the grid assembly which may cause early metal fatigue and the welds to fail. It will be apparent to those skilled in the art that a warped pan may prevent the edge thereof from forming a good seal with the central flange on the main beams. As a result, when the grid is top-filled with concrete the concrete may leak before it sets between the edge of the pan and the central flange. Leaking of the concrete is undesirable in that it requires additional labor to clean surfaces on which it leaks prior to the surfaces being painted. In addition, in bridge construction leaking concrete can cause a hazardous situation in areas below the grid when it is being top-filled with concrete. Further, if top-filling is carried out on a bridge over water, a pan which leaks concrete could result in an environmentally unsound condition requiring special precautions to comply with EPA requirements. While a sealer can be used to help prevent leaks at the edges of the pan, sealing all of the pan edges is labor intensive and increases the costs associated with manufacturing the grid.

Thus, a need exists for an improved form pan for half-depth concrete reinforced decks which avoids tack welding in its desired position, and which forms a good seal at the edges thereof with the flanges on the main beams.

SUMMARY OF THE INVENTION

A primary object of the present invention is to provide a grid assembly for grid reinforced concrete decks having an improved form pan.

A more specific object of the present invention is to provide an improved form pan for half-depth grid reinforced concrete decks.

A further object of the invention is to provide an improved form pan for a half-depth grid reinforced concrete deck which form pan is more positively retained in its desired position and does not require tack welding for stability.

Another object of the invention is to provide an improved form pan for a half-depth grid reinforced concrete deck which form pan prevents concrete from leaking around the edges thereof when the grid is top-filled.

Yet another object of the invention is to provide an improved form pan for a half-depth grid reinforced concrete deck which form pan enables mechanical locking of the pan in place on center flanges of the main beams when a cross bar positioned in aligned slots in the main beams is rotated into its upright position.

Still another object of the invention is to provide an improved form pan for a half-depth reinforced concrete deck which form pan, by its shape, is forced to securely rest on the central flanges of main beams when the grid is formed.

These and other objects and advantages are achieved by the present invention, which provides a grid assembly including a plurality of longitudinally extending main beams, each of the main beams having longitudinally spaced slots therein and a central flange thereon, a plurality of cross bars adapted to be inserted through the aligned slots and rotated into an upright position, and a form pan extending between two adjacent main beams and having a first and a second side portion adapted to rest on the central flange of the two adjacent main beams, respectively. The form pan includes at least a first ridge extending upwardly thereon having a height which enables the cross bars to come into contact therewith when the cross bars are in their upright position, the contact causing a downward force on the first ridge which mechanically locks the form pan between the cross bars and the flange on the adjacent main beams.

In accordance with a preferred embodiment of the instant invention, the form pan includes a second ridge extending upwardly thereon, the second ridge having a height which enables the cross bars to come into contact therewith when in the upright position. The contact with the second ridge causing a downward force thereon which, in conjunction with the downward force on the first ridge, mechanically locks the form pan between the cross bars and the flange on the adjacent main beams.

In accordance with another embodiment of the invention, the first and second ridges extend longitudinally along the form pan adjacent side edges thereof, respectively. Preferably, the ridges are continuous and parallel to each other.

In accordance with another aspect of the invention, a method is disclosed for manufacturing a grid assembly having a form pan which is mechanically locked in its desired position, and wherein the side edges of the form pan form a good seal with the central flanges on main beams to prevent concrete leakage therebetween.

BRIEF DESCRIPTION OF THE DRAWINGS

Other objects and advantages of the subject invention will become apparent from a study of the following specification when viewed in light of the accompanying drawings, in which.

DETAILED DESCRIPTION OF THE PREFERRED EMBODIMENTS

Figure 1:
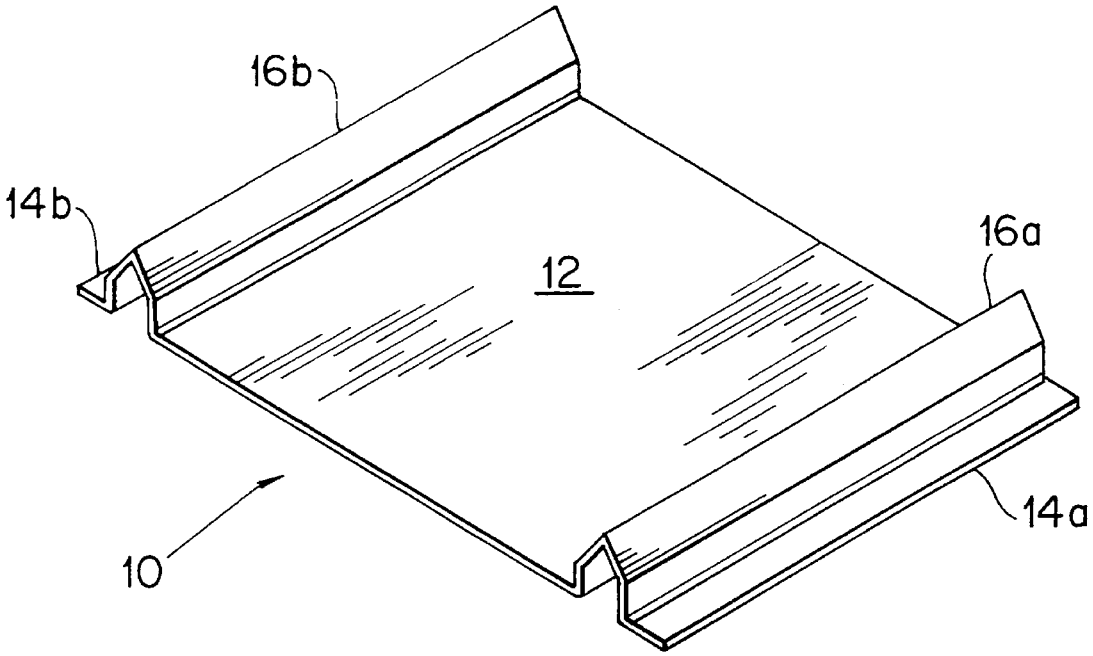
FIG. 1 depicts a top perspective view of the improved form pan of the instant invention.

Referring now to the drawings, wherein like numerals designate similar parts throughout the various views, and more particularly to FIG. 1, there is shown a form pan 10 constructed in accordance with the instant invention. The form pan 10 includes a generally flat body portion 12 having a pair of side edges 14*a* and 14*b*, respectively. The pan 10 may be made of any suitable sheet material, such as steel, aluminum or a composite material. A pair of raised or upwardly extending ridges 16*a* and 16*b* are provided for enabling the pan 10 to be secured in a grid assembly, as will be explained below with respect to FIGS. 2–8. Preferably, the ridges 16*a* and 16*b* extend along the length of the pan 10 adjacent the side edges 14*a* and 14*b* thereof, respectively. The pan 10 may, however, include only a single ridge and/or the ridges 16*a* and 16*b* may be located at positions other than adjacent to the side portions 14*a* and 14*b* thereof, depending on the particular needs of a given application in which the instant invention is used. While it is preferred that the ridges extend continuously along the pan, the ridges may be in the form of discrete ridge sections which are selectively positioned to contact cross bars used in the grid assembly, as will be explained below. While the ridges 16*a* and 16*b* may be formed on the pan by any suitable method, they are preferably integrally formed in the pan 10 by bending the side portions of the pan to form the ridges 16*a* and 16*b*, as shown in FIG. 1.

Figure 2:
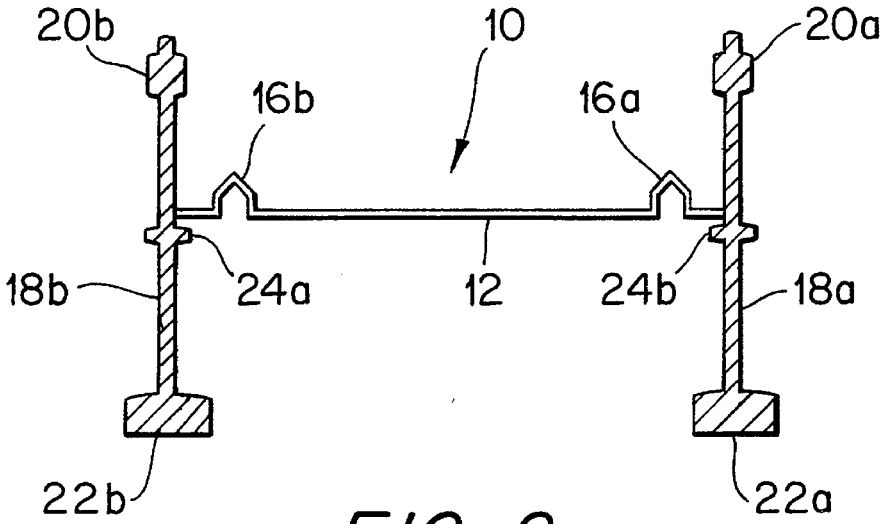
FIG. 2 depicts a front sectional view of the form pan of FIG. 1 positioned between two main beams of a grid assembly.

Referring now more particularly to FIG. 2, the pan 10 is particularly adapted for use in grid assemblies used for manufacturing grid reinforced concrete decks or the like. In such grid assemblies, a plurality of main beams 18*a* and 18*b* are provided and positioned in spaced parallel relation. The main beams 18*a* and 18*b* include an upper portion 20*a* and 20*b*, respectively, and a lower portion 22*a* and 22*b*, respectively. Each main beam 18*a* and 18*b* includes a centrally located flange 24*a* and 24*b*, respectively. The pan 10 is constructed to fit between the main beams 18*a* and 18*b* such that the side edges 14*a* and 14*b* thereof rest on the flanges 24*a* and 24*b*, respectively.

Figure 3:
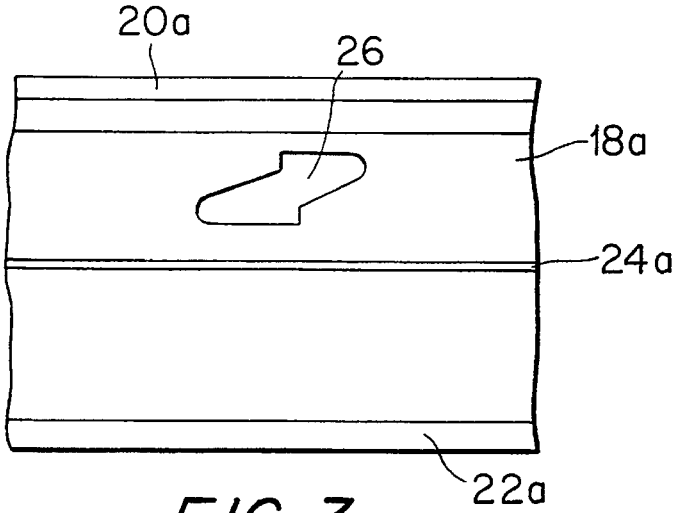
FIG. 3 depicts a side view of one of the two main beam of FIG. 2 having a cross bar slot therein.
Figure 4:
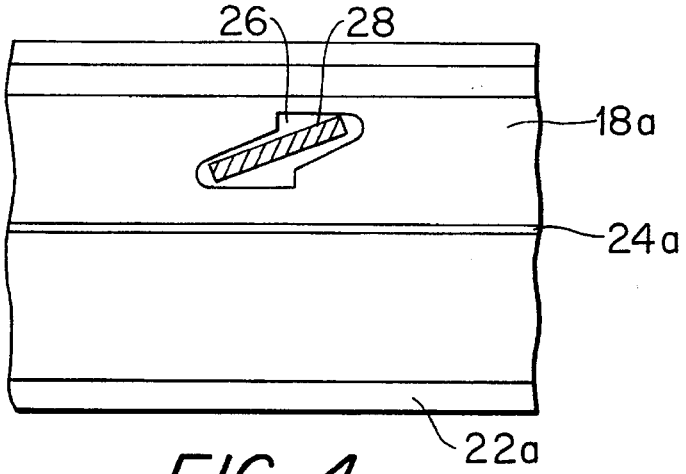
FIG. 4 depicts a side view of the main beam of FIG. 3 with a cross bar inserted through said slot in a substantially flat position.

As shown in FIG. 3, the upper portion of the main beams 18*a* and 18*b* each include a plurality of slots 26 therein (only one slot 26 being shown) spaced longitudinally along the upper portion 20*a* and 20*b* thereof, respectively. The main beams 18*a* and 18*b* are positioned such that the slots 26 therein are aligned between the beams. As shown in FIG. 4, the slots 26 are of a known configuration which enable a cross bar 28 to be inserted through the aligned slots 26 in the main beams 18*a* and 18*b*, while in a substantially flat position.

Figure 5:
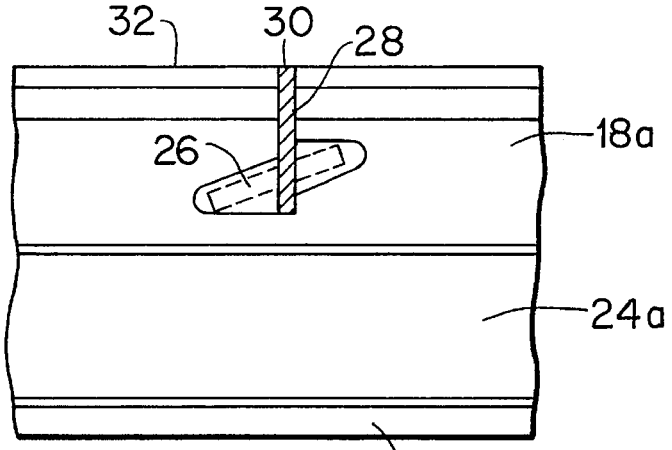
FIGS. 5 depicts the side view of the main beam of FIG. 4 with the cross bar rotated to an upright position while in the slot of the main beam.
Figure 7:
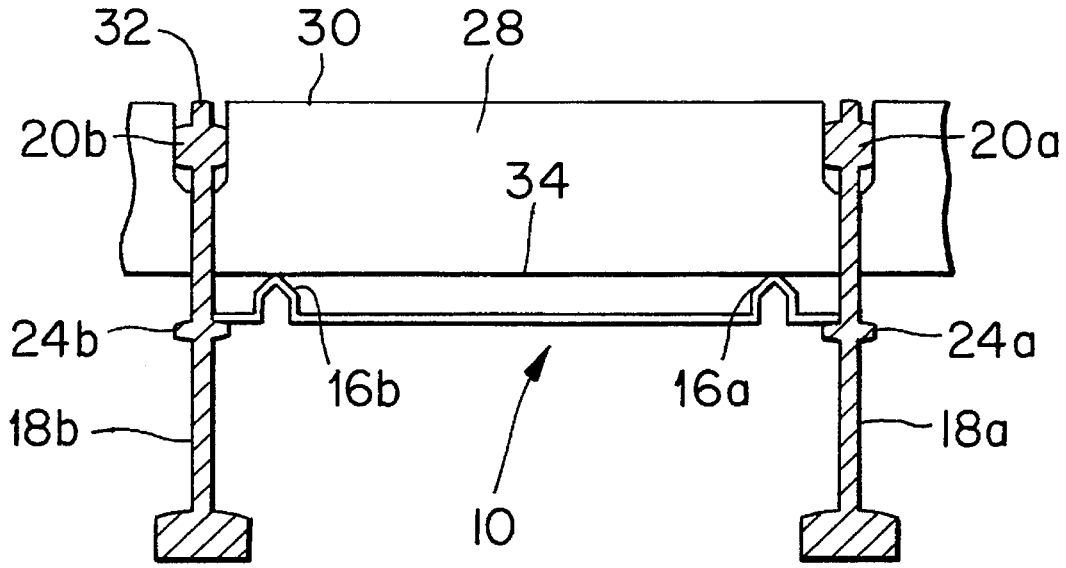
FIG. 7 depicts a front sectional view similar to that of FIG. 6, wherein the cross bar has been rotated to an upright position.
Figure 8:
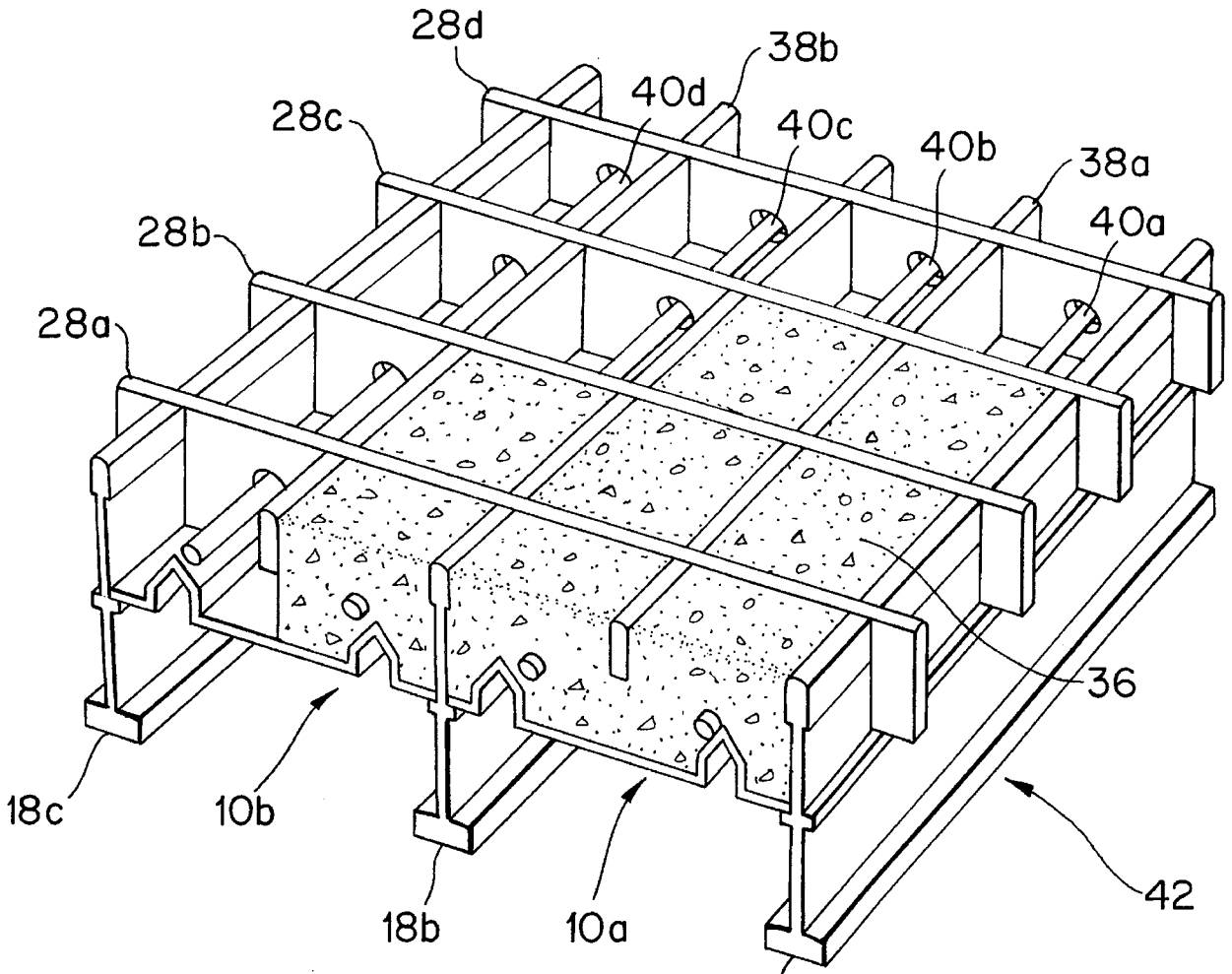
FIG. 8 depicts a perspective view of a half-depth grid reinforced concrete deck constructed in accordance with the instant invention and partially filled with concrete.

As shown in FIG. 5, the cross bar 28 is adapted to be rotated within the slot 26 to an upright position, wherein an upper edge 30 of the cross bar 28 rotates to a position which is substantially coplanar with an upper edge 32 of the main beams 18*a* and 18*b*. The cross bar 26 may be welded to the main beams 18*a* and 18*b* to maintain them in the upright position and to thereby form a rigid grid assembly with the main beams 18*a* and 18*b*. It is noted that, as one skilled in the art will readily understand from the description herein, a cross bar 28 is typically inserted through each of the aligned slots 26 in the main beams 18*a* and 18*b*. The number of aligned slots 26 and the spacing thereof can vary depending on the desired strength and overall configuration of the grid assembly being constructed. Obviously, closer spacing of the slots 26 along the main beams 18*a* and 18*b* would result in closer spacing of the cross bars 28, thereby providing a stronger grid assembly. It is also noted that, while only two main beams 18*a* and 18*b* are shown in FIGS. 2–7, typically a series of main beams in parallel spaced relation and having aligned slots 26 are used, as shown in FIG. 8 and in the patents to Greulich identified above. The total number of main beams and the spacing thereof depends on the requirements of the particular application in which the grating is intended to be used. The cross bars 28 have a length which enables then to pass through the aligned slots 26 in all of the main beams used in a particular application. In other words, for simplification only one section of the overall grid assembly is shown in the FIGS. 2–7, but it is readily understood therefrom that a complete grid assembly includes numerous sections made up of many main beams and cross bars.

Figure 6:
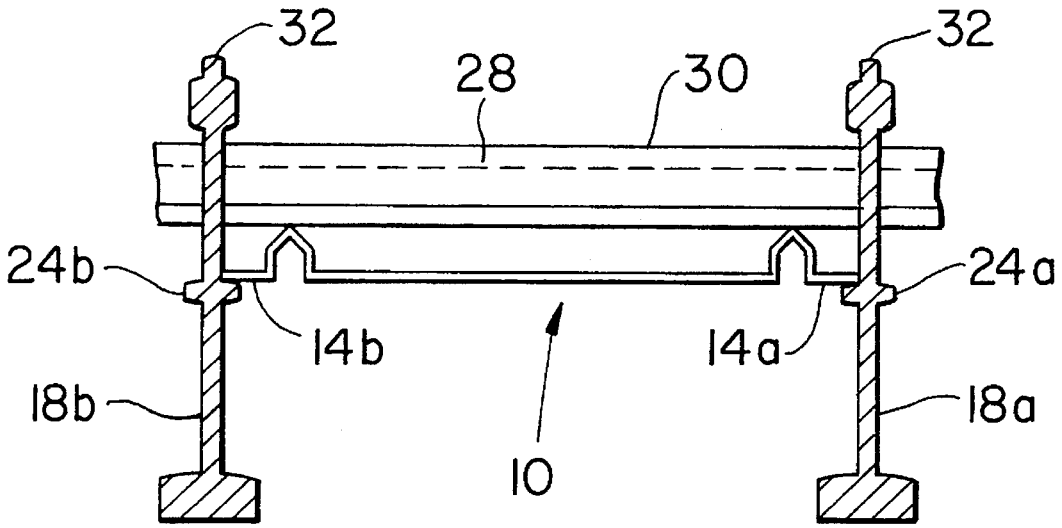
FIG. 6 depicts a front sectional view similar to that of FIG. 2 with a cross bar inserted through aligned slots in the main beams while in a substantially flat position.

Referring now more particularly to FIG. 6, a section of the grid assembly is shown having the pair of main beams 18*a* and 18*b* and a cross bar 28 extending therethrough while in a relatively flat position. The form pan 10 is located under the cross bar 28 and above the flanges 24*a* and 24*b* of the main beams. When the cross bar 28 is rotated to its upright position, as shown in FIG. 7, the bottom edge 34 thereof contacts the upper edge of the ridges 16*a* and 16*b* in a manner which causes a downward force on each of the ridges, thereby causing the side portions of the pan 10 to be press downwardly onto the flanges 24*a* and 24*b*. The downward force applied by the cross bar 28 on the pan mechanically locks the pan in its proper position on the flanges, thereby assuring that the pan does not shift during further manufacturing of the grid reinforced concrete deck. As a result of the secure locking of the pan 10, which is achieved by the ridges 16*a* and 16*b*, the conventional step of tack welding the pan 10 to the main beams 18*a* and 18*b* is no longer necessary.

The height of the ridges 16*a* and 16*b* on the pan 10 can vary depending on the particular application. The particular height depends on the relative height of the main beams and the cross bars and the location of flanges 24*a* and 24*b* on the main beams. The ridges preferably have a height which is substantially equal to the distance between the lower edge 34 of the cross bars 28 when in their upright position and the upper edge of the flanges 24*a* and 24*b*, thereby not interfering with the rotation of the cross bars 28 to the upright position, but providing sufficient downward force on the pan 10 once in the upright position to securely lock the pan 10 between the flanges 24*a* and 24*b* and the cross bars 28. Preferably, the upper edge of the ridges 16*a* and 16*b* are substantially smooth to enable the cross bar 28 to slide thereon when being rotated from its substantially flat position of FIG. 6 to the upright position of FIG. 7. The downward force applied to the pan 10 causes a good seal between the edges 14*a* and 14*b* thereof and the central flanges 24*a* and 24*b* on the main beams 18*a* and 18*b*, thereby preventing concrete from leaking therebetween when the grid is top-filled with concrete.

Referring now to FIG. 8, there is shown a larger section 42 of a complete grid assembly having two pans 10*a* and 10*b* constructed in accordance with the instant invention and positioned between three main beams 18*a*–18*c*. The grid section includes four cross bars 28*a*–28*d* in their upright positions in the slots 26 of the main beams 18*a*–18*c*. When the cross bars 28 are rotated upright, both of the pans 10*a* and 10*b* will be pressed downwardly into contact with the respective flanges on each of the main beams 18*a*–18*c*. Once all of the cross bars 28*a*–28*d* are in place, both of the pans 10*a* and 10*b* are securely held in their proper positions and the grid is ready to be top-filled with concrete 36, without concern that the pans 10 may shift to an undesirable position prior to or during top-filling with concrete 36 or that the concrete 36 will leak between the edges of the pans 10*a* and 10*b* and the central flanges on the main beams 18*a*–18*c*. Prior to top-filling, tertiary bars 38*a* and 38*b* and/or rebars 40*a*–40*d* may optionally be added to the grid depending on the requirements of the particular application in which the grid will be used. It is noted that any number of main beams and cross bars can be used, the number of pans 10 being dictated by the number of adjacent pair of beams in the grid. Once the grid is entirely filled with concrete 36 a substantially smooth deck surface is provided which can be used in any application in which reinforced heavy duty flooring is desired.

While the preferred forms and embodiments of the invention have been illustrated and described, it will be apparent to those of ordinary skill in the art that various changes and modifications may be made without deviating from the inventive concepts and spirit of the invention as set forth above, and it is intended by the appended claims to define all such concepts which come within the full scope and true spirit of the invention.

What is claimed is:

1. A grid assembly, comprising a plurality of longitudinally extending main beams in parallel spaced relation, each of said main beams having a plurality of longitudinally spaced slots therein and a central flange thereon, said beams being positioned such that said slots are aligned between said beams, a plurality of cross bars constructed to be inserted through said aligned slots and rotated into an upright position, and a form pan extending between two adjacent main beams of said plurality of main beams and having a first and a second side portion disposed on said central flange of said two adjacent main beams, respectively, said form pan including at least a first ridge extending upwardly thereon, said first ridge having a height which enables a lower edge of said cross bars to come into contact therewith when in said upright position, said contact causing a downward force on said first ridge which mechanically locks said form pan between said cross bars and said central flange on said adjacent main beams and places said first and second side portions in sealing engagement with the associated central flange of the main beams.

2. The grid assembly as defined in claim 1, wherein said form pan includes a second ridge extending upwardly thereon, said second ridge having a height which enables a lower edge of said cross bars to come into contact therewith when in said upright position, said contact with said second ridge causing a downward force thereon which, in conjunction with said downward force on said first ridge, mechanically locks said form pan between said cross bars and said central flange on said adjacent main beams.

3. The grid assembly as defined in claim 1, wherein said first ridge extends longitudinally along said pan.

4. The grid assembly as defined in claim 2, wherein said first ridge and said second ridge extend longitudinally along said pan.

5. The grid assembly as defined in claim 2, wherein said first ridge is located adjacent said first side portion of said form pan and said second ridge is located adjacent said second side portion of said form pan.

6. The grid assembly as defined in claim 4, wherein said first ridge is located adjacent said first side portion of said form pan and said second ridge is located adjacent said second side portion of said form pan.

7. The grid assembly as defined in claim 1, wherein said first ridge is integrally formed in said form pan.

8. The grid assembly as defined in claim 2, wherein said first ridge and said second ridge are integrally formed in said form pan.

9. The grid assembly as defined in claim 1, wherein said form pan is made from a flat sheet of material having bends therein which form said first ridge.

10. The grid assembly as defined in claim 3, wherein said form pan is made from a flat sheet of material having bends therein which form said first ridge.

11. The grid assembly as defined in claim 2, wherein said form pan is made from a flat sheet of material having bends therein which form said first ridge and said second ridge.

12. The grid assembly defined in claim 11, wherein said first ridge and said second ridge are of a substantially identical size and shape.

13. The grid assembly defined in claim 12, wherein said first ridge and said second ridge include a substantially smooth upper edge which enables said cross bars to slide thereon when being rotated to said upright position.

14. The grid assembly defined in claim 6, wherein said first ridge and said second ridge include a substantially smooth upper edge which enables said cross bars to slide thereon when being rotated to said upright position.

15. The grid assembly defined in claim 1, wherein said first ridge is continuous.

16. The grid assembly defined in claim 2, wherein said first ridge and said second ridge are continuous.

17. A grid reinforced concrete deck, comprising a plurality of longitudinally extending main beams in parallel spaced relation, each of said main beams having a plurality of longitudinally spaced slots therein and a central flange thereon, said beams being positioned such that said slots are aligned between said beams, a plurality of cross bars constructed to be inserted through said aligned slots and rotated into an upright position, a form pan extending between two adjacent main beams of said plurality of main beams and having a first and a second side portion disposed on said central flange of said two adjacent main beams, respectively, said form pan including at least a first ridge extending upwardly thereon, said first ridge having a height which enables a lower edge of said cross bars to come into contact therewith when in said upright position, said contact causing a downward force on said first ridge which mechanically locks said form pan between said cross bars and said central flange on said adjacent main beams and places said first and second side portions in sealing engagement with the associated central flange of the main beams, and a concrete filler between said main beams and said cross bars providing a flat deck surface.

18. The grid assembly as defined in claim 17, wherein said form pan includes a second ridge extending upwardly thereon, said second ridge having a height which enables a lower edge of said cross bars to come into contact therewith when in said upright position, said contact with said second ridge causing a downward force thereon which, in conjunction with said downward force on said first ridge, mechanically locks said form pan between said cross bars and said central flange on said adjacent main beams.

19. The grid assembly as defined in claim 17, wherein said first ridge extends longitudinally along said pan.

20. The grid assembly as defined in claim 18, wherein said first ridge and said second ridge extend longitudinally along said pan.

21. The grid assembly as defined in claim 18, wherein said first ridge is located adjacent said first side portion of said form pan and said second ridge is located adjacent said second side portion of said form pan.

22. The grid assembly as defined in claim 17, wherein said first ridge is continuous.

23. The grid assembly as defined in claim 18, wherein said first ridge and said Second ridge are continuous and are integrally formed in said form pan.

24. Method of manufacturing a grid, comprising the steps of arranging a plurality of longitudinally extending main beams, having a plurality of longitudinally spaced slots therein and a central flange thereon, in parallel spaced relation such that said slots are aligned between said beams, inserting a plurality of cross bars through the aligned slots, positioning a form pan between adjacent main beams of said plurality of main beams such that side edges of said from pan rest on said central flange of said adjacent beams, respectively, said pan being positioned at a height which enables a lower edge of said cross bars to come into contact with an upward ridge on said form pan when said cross bars are rotated into an upright position, rotating said cross bars to said upright position to thereby cause said cross bars to contact said ridge and cause a downward force on said ridge to mechanically lock said form pan between said cross bars and said central flange on said adjacent main beams with the side edges of the pan in sealing engagement with the associated central flange of the main beams.

25. The method as defined in claim 24, further including the step of adding concrete to said grid to form a grid reinforced concrete deck.

* * * * *